US010137322B2

(12) United States Patent
Perner

(10) Patent No.: US 10,137,322 B2
(45) Date of Patent: Nov. 27, 2018

(54) SAFETY HARNESS

(71) Applicant: D B Industries, LLC, Red Wing, MN (US)

(72) Inventor: Judd J. Perner, Red Wing, MN (US)

(73) Assignee: D B Industries, LLC, Maplewood, MN (US)

( * ) Notice: Subject to any disclaimer, the term of this patent is extended or adjusted under 35 U.S.C. 154(b) by 0 days.

(21) Appl. No.: 14/800,327

(22) Filed: Jul. 15, 2015

(65) Prior Publication Data

US 2016/0089554 A1 Mar. 31, 2016

Related U.S. Application Data

(60) Provisional application No. 62/173,823, filed on Jun. 10, 2015, provisional application No. 62/056,027, filed on Sep. 26, 2014.

(51) Int. Cl.
*A62B 35/00* (2006.01)

(52) U.S. Cl.
CPC ..... *A62B 35/0025* (2013.01); *A62B 35/0006* (2013.01); *A62B 35/0018* (2013.01)

(58) Field of Classification Search
CPC . A62B 35/00; A62B 35/0006; A62B 35/0018; A62B 35/0025; A62B 35/0031
See application file for complete search history.

(56) References Cited

U.S. PATENT DOCUMENTS

| | | | | |
|---|---|---|---|---|
| 1,967,767 | A * | 7/1934 | Diez | A62B 35/00 182/3 |
| 2,675,150 | A * | 4/1954 | Ackerman | A62B 9/04 224/635 |
| 3,448,826 | A * | 6/1969 | Rosenblum | A62B 35/0012 182/3 |
| 3,869,021 | A * | 3/1975 | Sutherland | A62B 35/0018 182/135 |
| 4,074,839 | A | 2/1978 | Wood et al. | |
| 4,099,657 | A | 7/1978 | Zufich | |
| 5,131,576 | A * | 7/1992 | Turnipseed | A45F 3/08 224/262 |
| 5,366,126 | A | 11/1994 | Dausien | |
| 5,531,292 | A * | 7/1996 | Bell | A62B 35/0037 182/3 |
| D391,368 | S * | 2/1998 | Hall | D24/110 |
| 6,253,874 | B1 * | 7/2001 | Casebolt | B64D 17/30 182/3 |

(Continued)

FOREIGN PATENT DOCUMENTS

| | | |
|---|---|---|
| RU | 2290975 | 1/2007 |
| RU | 179280 | 5/2018 |

OTHER PUBLICATIONS

Owner's Manual, Osprey Atmos™ or Aura™ Series pack, known of prior to filing the application, 2 pages.

(Continued)

*Primary Examiner* — Daniel P Cahn
(74) *Attorney, Agent, or Firm* — Peter L. Olson

(57) ABSTRACT

A safety harness comprises shoulder straps, a waist strap, and a weight distribution assembly interconnecting the shoulder straps and the waist strap. The weight distribution assembly is configured and arranged to transfer a load from proximate the shoulder straps to proximate the waist strap.

19 Claims, 16 Drawing Sheets

(56) References Cited

U.S. PATENT DOCUMENTS 6,290,111 B1 * 9/2001 Hedenberg ..... A45F 3/10 224/262
6,405,728 B1 * 6/2002 Van Hall ..... A62B 25/00 128/202.13
6,467,851 B1 * 10/2002 Mannell ..... A47D 13/086 119/770
6,971,476 B2 12/2005 Wolner
D556,383 S * 11/2007 Petzl ..... D29/101.1
7,673,777 B2 * 3/2010 Gleason, Jr. ..... A45F 3/08 224/635
8,006,877 B2 * 8/2011 Lowry ..... A45F 3/04 224/262
8,181,833 B2 * 5/2012 Wangeby ..... A45F 3/14 224/262
8,356,604 B2 * 1/2013 Tweardy ..... A61F 5/055 128/869
8,356,692 B1 * 1/2013 Steck ..... A62B 35/0025 182/129
8,701,674 B2 * 4/2014 Tweardy ..... A61F 5/055 128/869
8,740,028 B2 6/2014 Hairston et al.
9,220,333 B2 * 12/2015 Losos ..... A45F 3/10
2004/0140152 A1 * 7/2004 Richardson ..... A62B 35/0037 182/3
2004/0163156 A1 8/2004 Schweer
2004/0200481 A1 * 10/2004 Chapman ..... A45F 3/14 128/875
2005/0067221 A1 * 3/2005 Wolner ..... A62B 35/0031 182/3
2006/0054387 A1 * 3/2006 Fortin ..... A62B 35/0025 182/3
2006/0102423 A1 * 5/2006 Lang ..... A62B 35/0012 182/36
2006/0137097 A1 * 6/2006 Frost ..... A61F 5/05825 5/628
2006/0207828 A1 * 9/2006 D'Acquisto ..... A62B 35/04 182/3
2007/0090137 A1 * 4/2007 Kim ..... A45F 3/047 224/153
2008/0060873 A1 * 3/2008 Lang ..... A62B 35/0018 182/3
2008/0257928 A1 * 10/2008 Lowry ..... A45F 3/04 224/638
2009/0026012 A1 * 1/2009 Petzl ..... A62B 35/0025 182/6
2009/0255756 A1 * 10/2009 Green ..... A62B 35/0012 182/3
2009/0314578 A1 * 12/2009 Hede ..... A62B 35/0012 182/3
2010/0200329 A1 * 8/2010 Johnson ..... A62B 35/0025 182/3
2010/0242233 A1 * 9/2010 Wolner ..... A62B 35/0031 24/197
2010/0252361 A1 * 10/2010 Wood ..... A62B 1/14 182/6
2011/0017546 A1 * 1/2011 Nichols, Jr. ..... A62B 35/0018 182/3
2012/0222912 A1 * 9/2012 Wood ..... A62B 1/14 182/6
2012/0292361 A1 11/2012 Thiruppathi
2013/0037347 A1 * 2/2013 Wood ..... A62B 1/14 182/6
2013/0197410 A1 8/2013 Petterson et al.
2014/0034419 A1 2/2014 Gopfert
2014/0069978 A1 3/2014 Callison
2014/0239031 A1 8/2014 Robert
2015/0217150 A1 * 8/2015 Harris ..... A62B 35/0093 182/5
2015/0273250 A1 * 10/2015 Bina ..... A62B 99/00 182/8
2017/0216635 A1 * 8/2017 Stibilj ..... A62B 35/0025

OTHER PUBLICATIONS

Atmos/Aura AG™ Series, Owner's Manual, Osprey, downloaded from http://www.ospreypacks.com/user_manuals/OM_AtmosAura_S15_ENG.pdf, Nov. 2014, 10 pages.
New Miller Revolution Harness, www.millerfallprotection.com, known of prior to filing the application, 8 pages.
Werner H133101 Blue Armor 2000 Safety Harness, downloaded from http://www.industrialproducts.com, on Sep. 24, 2014, 1 page.
66990 Buck R.A.T.H. (Rope Access Technicians Harness), downloaded from http://www.buckinghammfig.com on Sep. 29, 2014, 1 page.
Strong Arm™ Product Development Test 2 for Target, May 21, 2013, 11 pages.
International Search Report issued in PCT/US2015/050130 dated Jan. 18, 2016, 5 pages.

* cited by examiner

SAFETY HARNESS

CROSS-REFERENCE TO RELATED APPLICATION

This application claims the benefit of U.S. Provisional Patent Application Ser. No. 62/056,027 filed Sep. 26, 2014 and U.S. Provisional Patent Application Ser. No. 62/173,823 filed Jun. 10, 2015, which are hereby incorporated by reference.

BACKGROUND OF THE INVENTION

Various occupations place people in precarious positions at relatively dangerous heights thereby creating a need for fall protection or fall-arresting safety apparatus. Among other things, such apparatus usually include a safety line interconnected between a support structure and a safety harness donned by a person working in proximity to the support structure.

Commonly used safety harnesses include flexible webbing that extends over the user's shoulders and a considerable amount of weight from the safety harness, tools, and other equipment connected to the safety harness is applied to the user's shoulders. Harnesses that include a tool belt with an adjustment element do reduce the loads associated with tools connected to the tool belt but do not aid in supporting the weight of the upper portion of the harness or auxiliary equipment that may be attached to the dorsal D-ring of the harness. Therefore, some disadvantages of these types of harnesses are loads applied to the user's shoulders causes discomfort, which can lead to fatigue; tension in the shoulder straps causes the chest strap and other components above the dorsal D-ring to move upward, which requires unnecessary readjustment; and the dorsal D-ring is prone to sliding downward on the user's back and out of proper adjustment due to the weight of personal self-retracting lifelines (SRLs), energy absorbing lanyards, restraint lanyards, and other fall protection equipment.

For the reasons stated above and for other reasons stated below, which will become apparent to those skilled in the art upon reading and understanding the present specification, there is a need in the art for an improved safety harness with a weight distribution assembly.

BRIEF SUMMARY OF THE INVENTION

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, a safety harness comprises shoulder straps, a waist strap, and a weight distribution assembly interconnecting the shoulder straps and the waist strap. The weight distribution assembly is configured and arranged to transfer a load from proximate the shoulder straps to proximate the waist strap.

In one embodiment, a safety harness comprises a dorsal pad assembly, at least one of a waist belt and a hip pad, shoulder straps interconnecting the dorsal pad assembly and the at least one of the waist belt and the hip pad, and a support assembly interconnecting the dorsal pad assembly and the at least one of the waist belt and the hip pad. The support assembly is at least semi-rigid and is configured and arranged to transfer a majority of a load from proximate the dorsal pad assembly and thereby proximate the shoulder straps to proximate the at least one of the waist belt and the hip pad.

BRIEF DESCRIPTION OF THE DRAWINGS

The present invention can be more easily understood, and further advantages and uses thereof can be more readily apparent, when considered in view of the detailed description and the following Figures in which.

In accordance with common practice, the various described features are not drawn to scale but are drawn to emphasize specific features relevant to the present invention. Reference characters denote like elements throughout the Figures and the text.

DETAILED DESCRIPTION OF THE INVENTION

Figure 1:
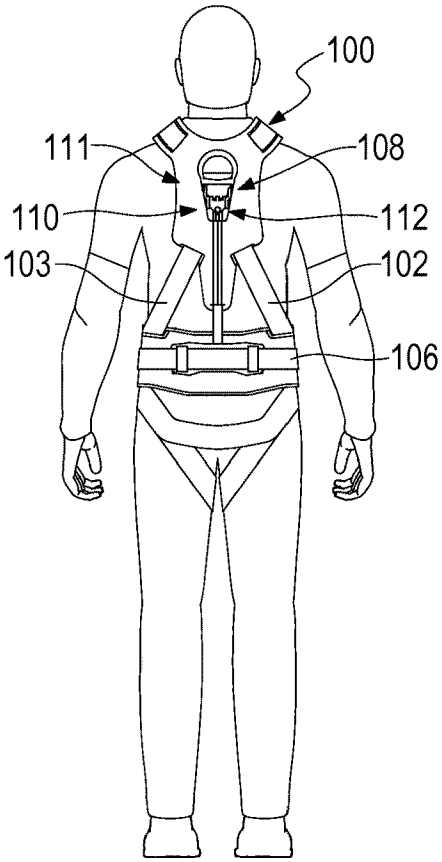
FIG. 1 is a rear view of a safety harness including a weight distribution assembly constructed in accordance with the present invention and donned by a user.
Figure 2:
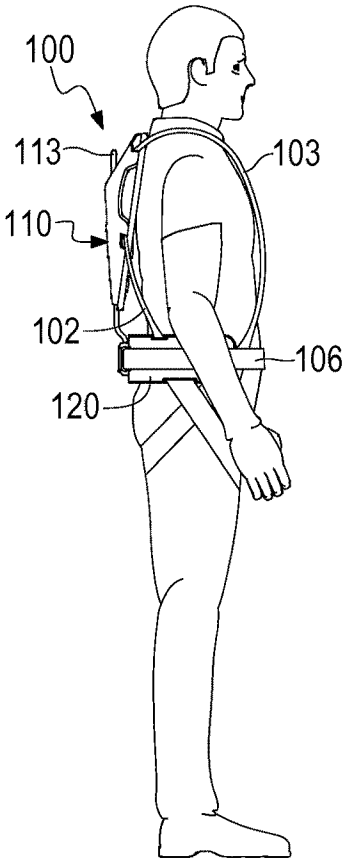
FIG. 2 is a side view of the safety harness donned by the user shown in FIG. 1.
Figure 3:
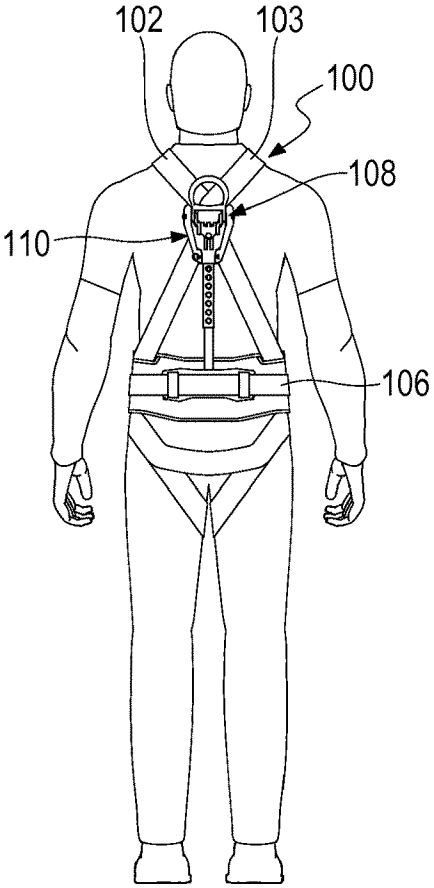
FIG. 3 is a rear view of the safety harness donned by the user shown in FIG. 1 with padding removed.
Figure 4:
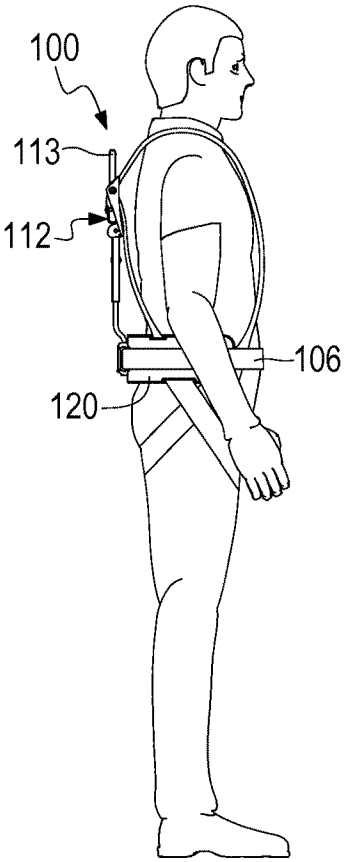
FIG. 4 is a side view of the safety harness donned by the user shown in FIG. 3.
Figures 5, 6:
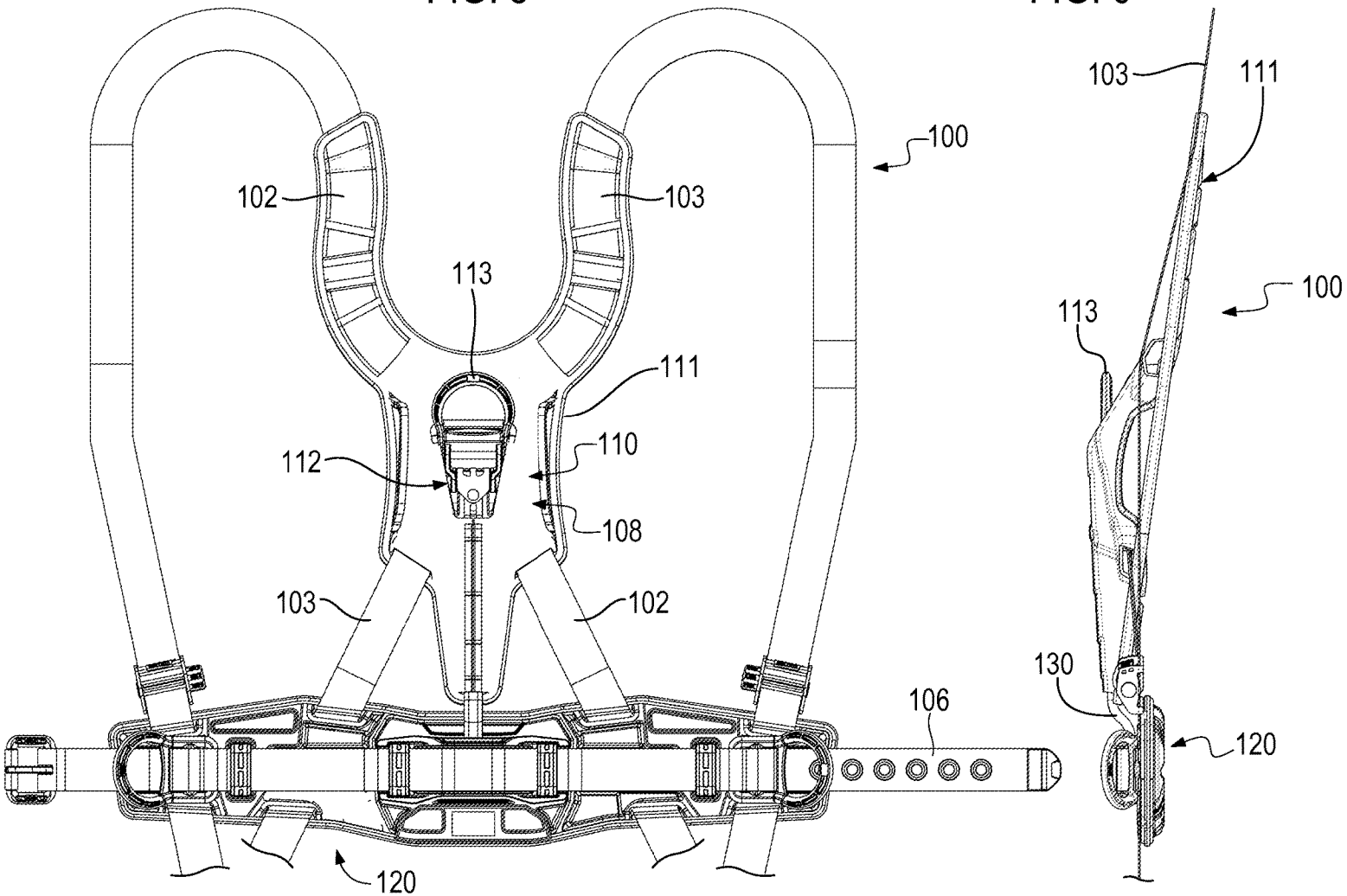
FIG. 5 is a rear plan view of the safety harness shown in FIG. 1.
FIG. 6 is a side view of the safety harness shown in FIG. 5.
Figure 8:
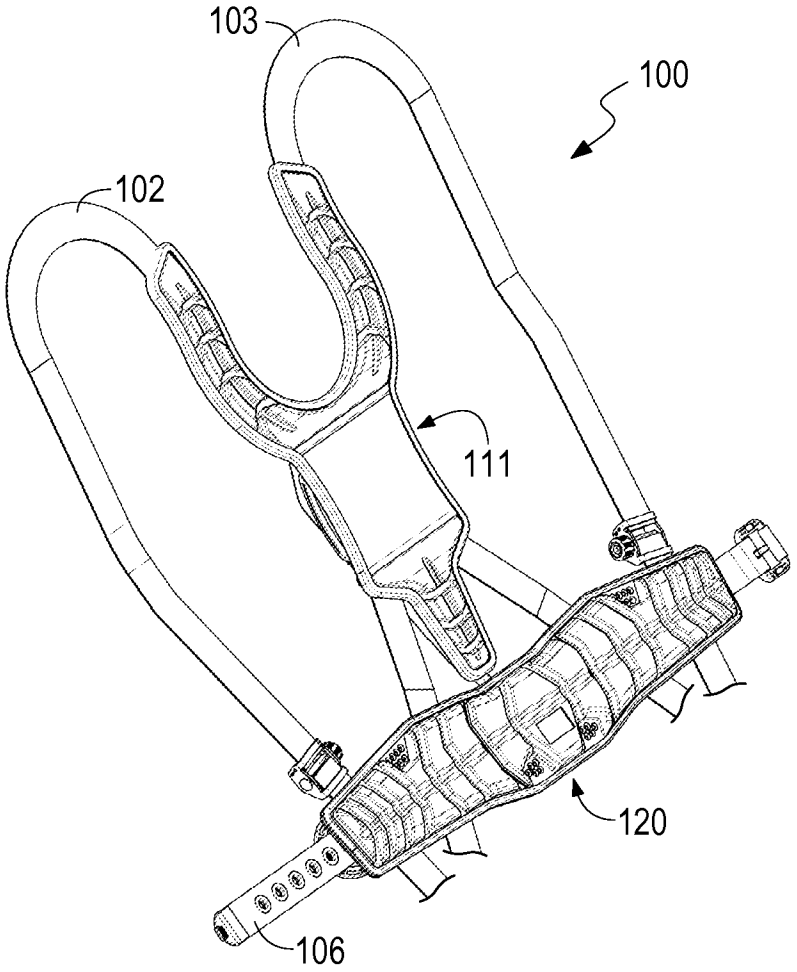
FIG. 8 is a front perspective view of the safety harness shown in FIG. 1.
Figure 7:
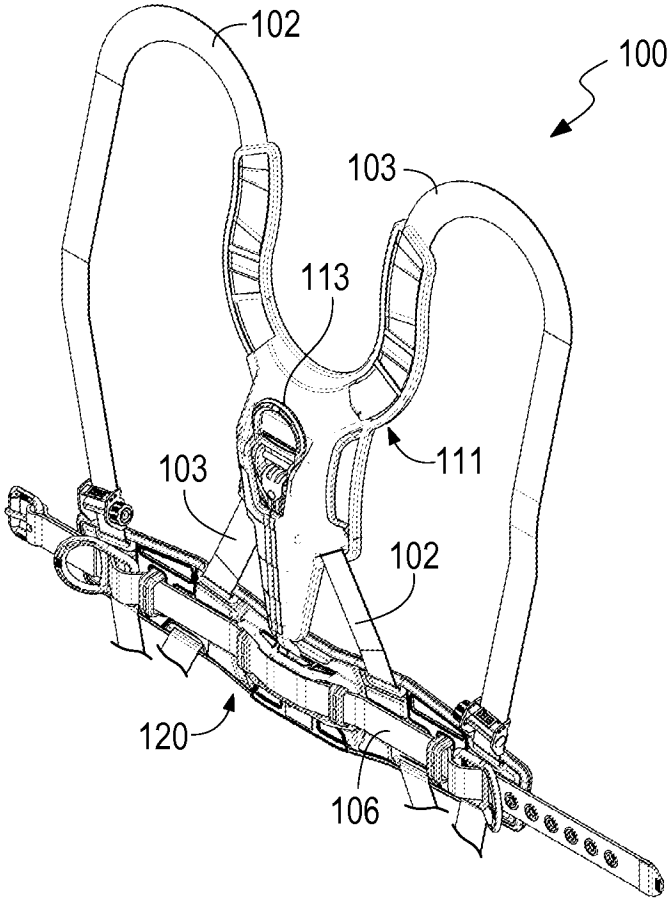
FIG. 7 is a rear perspective view of the safety harness shown in FIG. 1.
Figure 9:
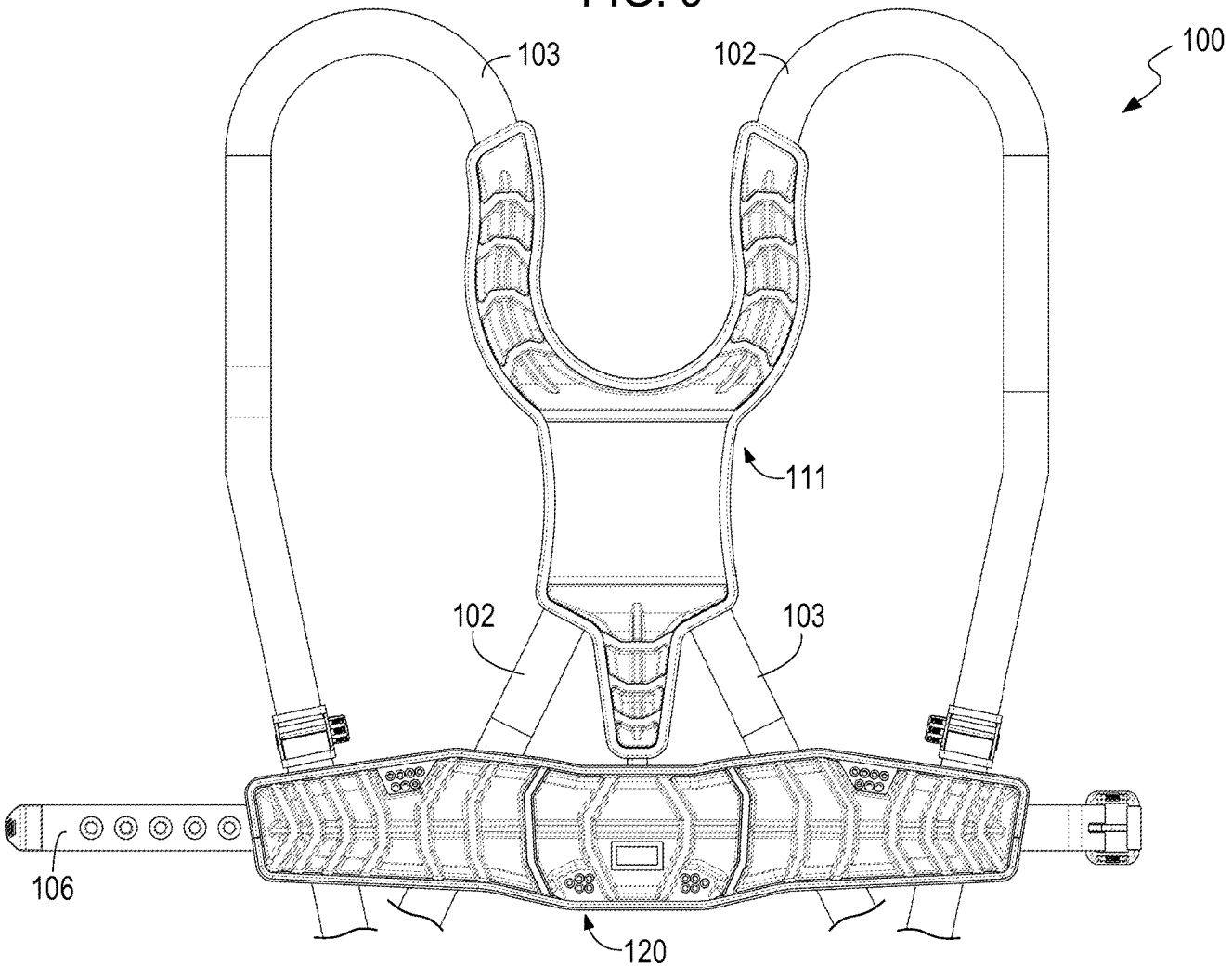
FIG. 9 is a front plan view of the safety harness shown in FIG. 1.

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

Embodiments of the present invention generally provide a safety harness with a semi-rigid to rigid weight distribution assembly including a support member or a support assembly interconnecting the dorsal pad assembly and the waist belt or hip pad so that when the waist belt is properly tightened and weight is added to the D-ring of the dorsal pad assembly, the weight distribution assembly is loaded in compression and transfers a majority of the load/weight to the user's hip or pelvis area, which is supported by the user's legs. This reduces the weight applied proximate the user's shoulders and reduces the risk of shoulder pain and lower back pain. In addition, this greatly reduces tension in the harness shoulder straps, which could affect how the harness is positioned on the user. Examples of materials that could be used for the support member or support assembly are metal, composite materials, plastic, carbon fiber, and other suitable materials.

The vertically loaded weight distribution assembly could take a variety of forms and could include a single support member, multiple support members, and pivot point(s) in various locations to increase comfort and mobility. The weight distribution assembly could be at least partially integral with the full body harness, for example at least partially integral with the dorsal pad assembly, at least partially integral with the hip pad, or it could be an add-on feature that is connected via connecting elements proximate the dorsal pad assembly and the waist belt/hip pad.

The weight distribution assembly could be connected to the dorsal pad assembly and the waist belt/hip pad via any suitable connecting member such as, but not limited to, thread (sewing), rivets, connectors, pockets, channels, etc. The weight distribution assembly could also be retractable, telescoping, or otherwise adjustable in length.

One advantage of the present invention is the increased comfort for the user donning the safety harness due to the redistributed weight of tools, equipment, etc. from proximate the user's shoulders to the user's hip/waist area. As a result, users are able to work for longer periods of time in greater comfort and utilize larger or heavier personal self-retracting lifelines.

There is currently no commercial example of a full body safety harness with a vertically loaded column, stay member, support member, support assembly, or other weight transfer member that transfers weight from proximate a user's shoulders to the user's hip or pelvis area.

In one embodiment, a harness 100 includes first and second shoulder straps 102 and 103, a waist strap 106, and a weight distribution assembly 108. Optionally, padding 111 could be used for added comfort between the shoulder straps and the user from proximate the user's collar bones to the dorsal pad assembly 110. Generally, the weight distribution assembly 108 includes a dorsal pad assembly 110 operatively connected to the shoulder straps 102 and 103, a connector 160 operatively connected to the waist strap 106, and a support assembly 129 interconnecting the dorsal pad assembly 108 and the connector 160.

Figure 15:
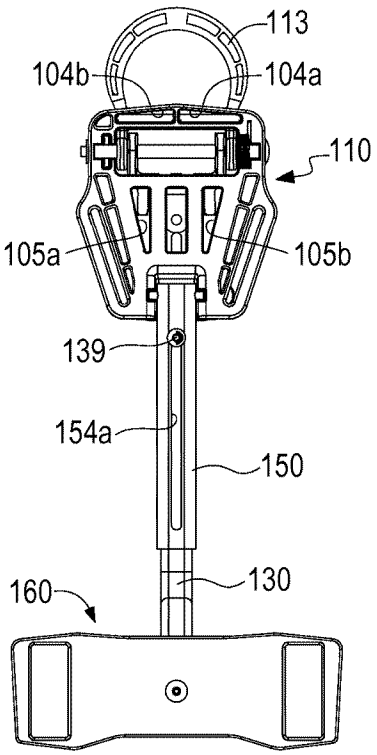
FIG. 15 is a front view of the weight distribution assembly shown in FIG. 10.
Figure 14:
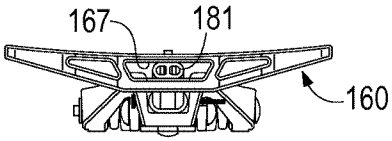
FIG. 14 is a bottom view of the weight distribution assembly shown in FIG. 10.

Dorsal pad assemblies are commonly used to interconnect shoulder straps and a D-ring. Generally, dorsal pad assemblies include slots though which the shoulder straps are routed to connect the D-ring to the shoulder straps. As shown in FIG. 15, the dorsal pad assembly 110 includes slots 104*a* and 105*a* through which the shoulder strap 102 is routed and includes slots 104*b* and 105*b* through which the shoulder strap 103 is routed. The D-ring 113 is positioned between the upper slots 104*a* and 104*b* and the lower slots 105*a* and 105*b*, and the shoulder straps 102 and 103 are also routed through the D-ring 113. It is recognized that the shoulder straps could be routed differently through the dorsal pad assembly. The dorsal pad assembly 110 includes additional features not known in the art. The dorsal pad assembly 110 includes a connector assembly 112, which allows safety equipment to be quickly connected to the D-ring 113 and keeps the ring portion of the D-ring available for additional safety equipment, rescue, and the like. The dorsal pad assembly 110 also includes a receiver portion 114 configured and arranged to receive a portion of the support assembly 129. Preferably, the receiver portion 114 is integral with the dorsal pad assembly 110, but it could be a separate component operatively connected to the dorsal pad assembly 110. The receiver portion 114 includes sides 116*a* and 116*b* interconnecting a top 115 to a base of the dorsal pad assembly 110 below the D-ring 113. The sides 116*a* and 116*b* include corresponding, aligned apertures 117*a* and 117*b* through which a fastener 122 extends to pivotally connect the support assembly to the dorsal pad assembly 110. The base of the dorsal pad assembly 110, the top 115, and the sides 116*a* and 116*b* form a cavity 118 into which a portion of the support assembly 129 is inserted. It is recognized that other suitable ways to connect a portion of the support assembly to the dorsal pad assembly could also be used.

Figure 26:
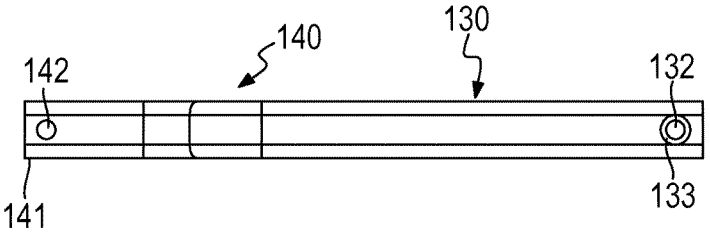
FIG. 26 is a rear view of an embodiment support member.
Figure 27:
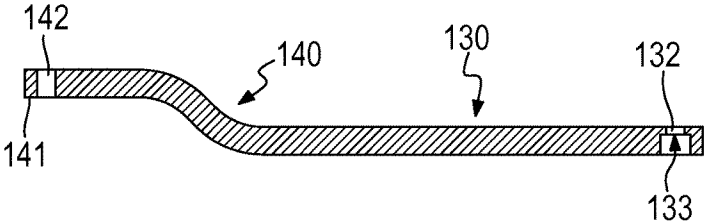
FIG. 27 is a side cross-section view of the support member shown in FIG. 26.
Figure 28:
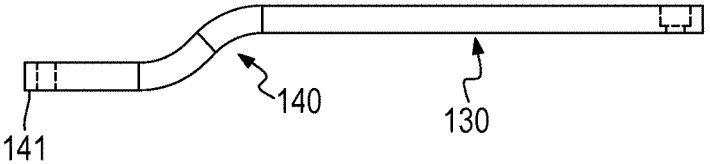
FIG. 28 is a side view of the support member shown in FIG. 26.
Figure 29:
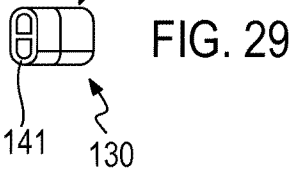
FIG. 29 is a bottom view of the support member shown in FIG. 26.
Figure 30:
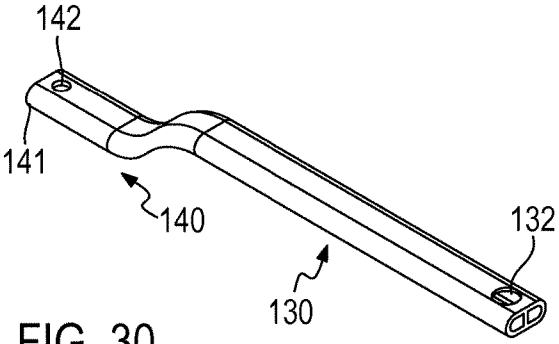
FIG. 30 is a perspective view of the support member shown in FIG. 26.
Figures 31, 32, 33, 34, 35:
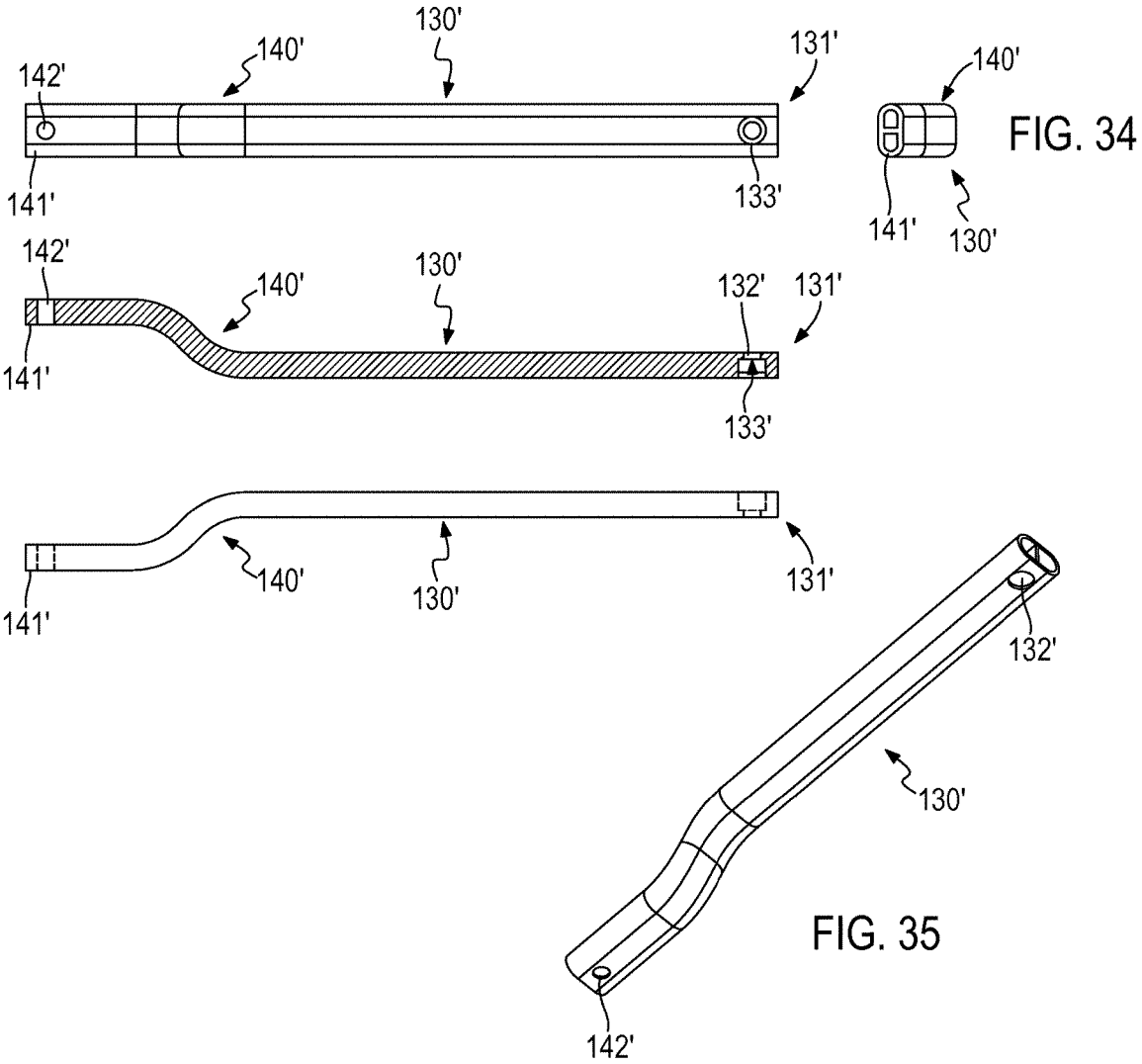
FIG. 31 is a rear view of another embodiment support member.
FIG. 32 is a side cross-section view of the support member shown in FIG. 31.
FIG. 33 is a side view of the support member shown in FIG. 31.
FIG. 34 is a bottom view of the support member shown in FIG. 31.
FIG. 35 is a perspective view of the support member shown in FIG. 31.
Figure 40:
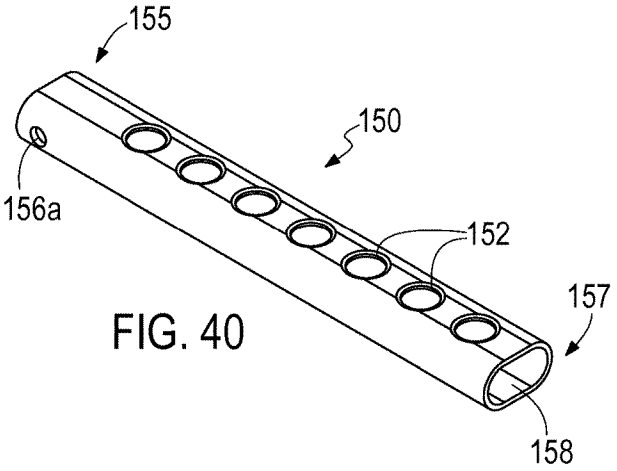
FIG. 40 is a rear perspective view of the adjustable member shown in FIG. 36.
Figure 41:
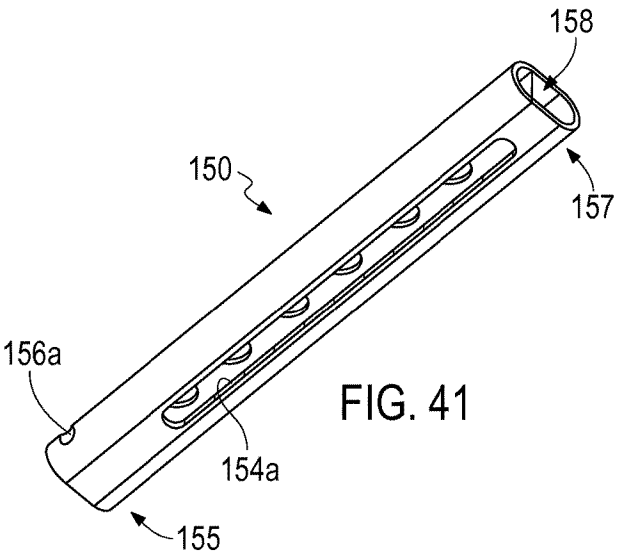
FIG. 41 is a front perspective view of the adjustable member shown in FIG. 36.
Figure 36:
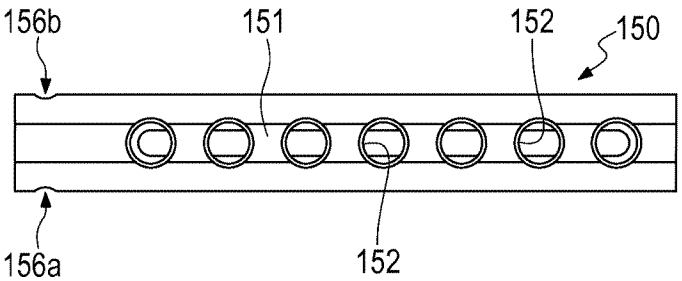
FIG. 36 is a rear view of the adjustable member shown in FIG. 17.
Figure 37:
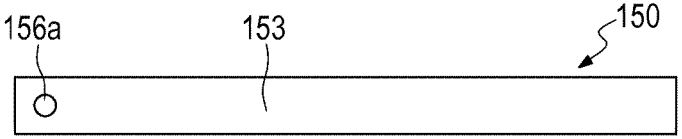
FIG. 37 is a side view of the adjustable member shown in FIG. 36.
Figure 38:
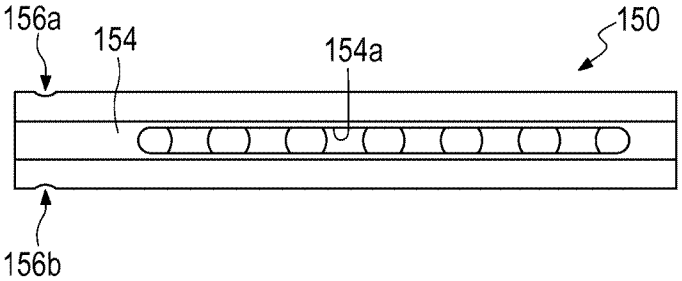
FIG. 38 is a front view of the adjustable member shown in FIG. 36.
Figure 39:
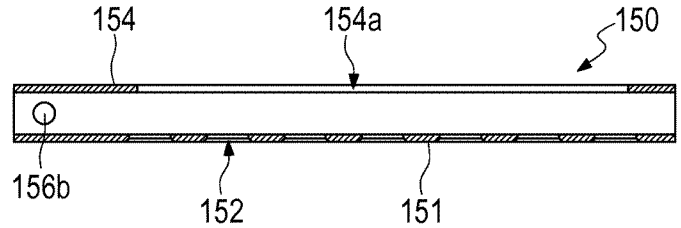
FIG. 39 is a side cross-section view of the adjustable member shown in FIG. 36.
Figure 42:
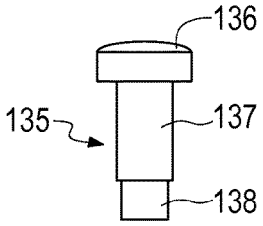
FIG. 42 is a side view a button of the support member.
Figure 43:
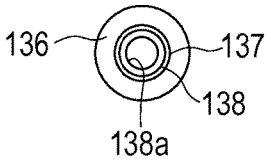
FIG. 43 is a rear view of the button shown in FIG. 42.
Figure 44:
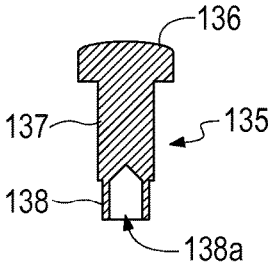
FIG. 44 is a side cross-section view of the button shown in FIG. 42.
Figure 45:
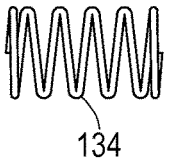
FIG. 45 is a side view of a biasing member of the support member.
Figure 46:
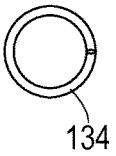
FIG. 46 is a rear view of the biasing member shown in FIG. 45.
Figure 47:
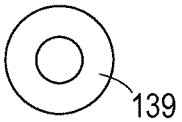
FIG. 47 is a rear view of a washer of the support member.
Figure 48:
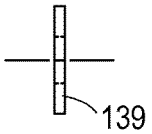
FIG. 48 is a side view of the washer shown in FIG. 47.
Figure 49:
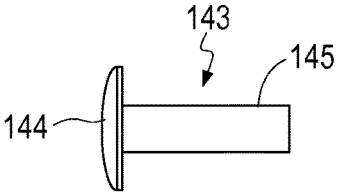
FIG. 49 is a side view of a fastener of the support member.
Figure 50:
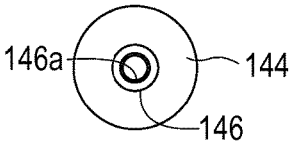
FIG. 50 is a rear view of the fastener shown in FIG. 49.
Figure 51:
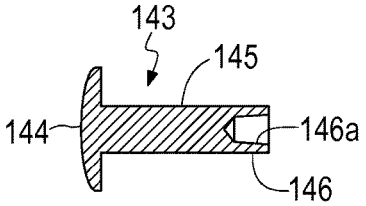
FIG. 51 is a side cross-section view of the fastener shown in FIG. 49.
Figure 52:
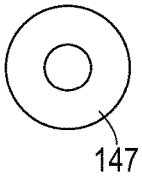
FIG. 52 is a rear view of a washer of the support member.
Figure 53:
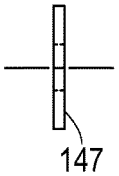
FIG. 53 is a side view of the washer shown in FIG. 52.

The support assembly 129 includes a support member 130 or 130' and an adjustable member 150, which are movable relative to one another so that the length of the support assembly 129 may be adjusted as desired. The support member 130 is preferably an elongate member including a bend 140 proximate its second, bottom end 141. The bend 140 allows the first, top end 131 to be proximate the user's shoulder blades and the second, bottom end 141 to be proximate the user's waist, which allows for a more downward, vertical transfer of weight when the user is in an upright, standing position. Preferably, the bend 140 includes two curves that angle the support member 130 approximately 45 degrees to create an offset of approximately ¾ inch, which helps keep the support member 130 away from the user's back when bending forward. It is recognized that other angles and offset dimensions could be used. At least one bore may extend longitudinally through the support member 130 to reduce its weight. The first end 131 includes an aperture 132 extending through its top and bottom surfaces. As shown in FIGS. 26 and 27, the aperture 132 is larger proximate the top surface than the bottom surface to form a seat portion 133. The aperture 132 is configured and arranged to receive a button assembly. The button assembly includes a biasing member 134, a button 135, and a securing member 139. These are shown in FIGS. 42-48. The button 135 includes a head 136, a shaft 137, and an end 138 having a cavity 138 extending longitudinally through a portion of its distal end. The shaft 137 extends through a bore in the biasing member 134, the biasing member 134 is captured in the aperture 132 between the seat portion 133 and the head 136 of the button 135, and the securing member 139 is connected to the end 138 of the button 135 proximate the bottom surface of the first end 131. The end 138 of the button 135 is deformed like a rivet to secure the button 135, and the securing member 139 is a washer. The second end 141 includes an aperture 142 extending through its top and bottom surfaces.

Figure 17:
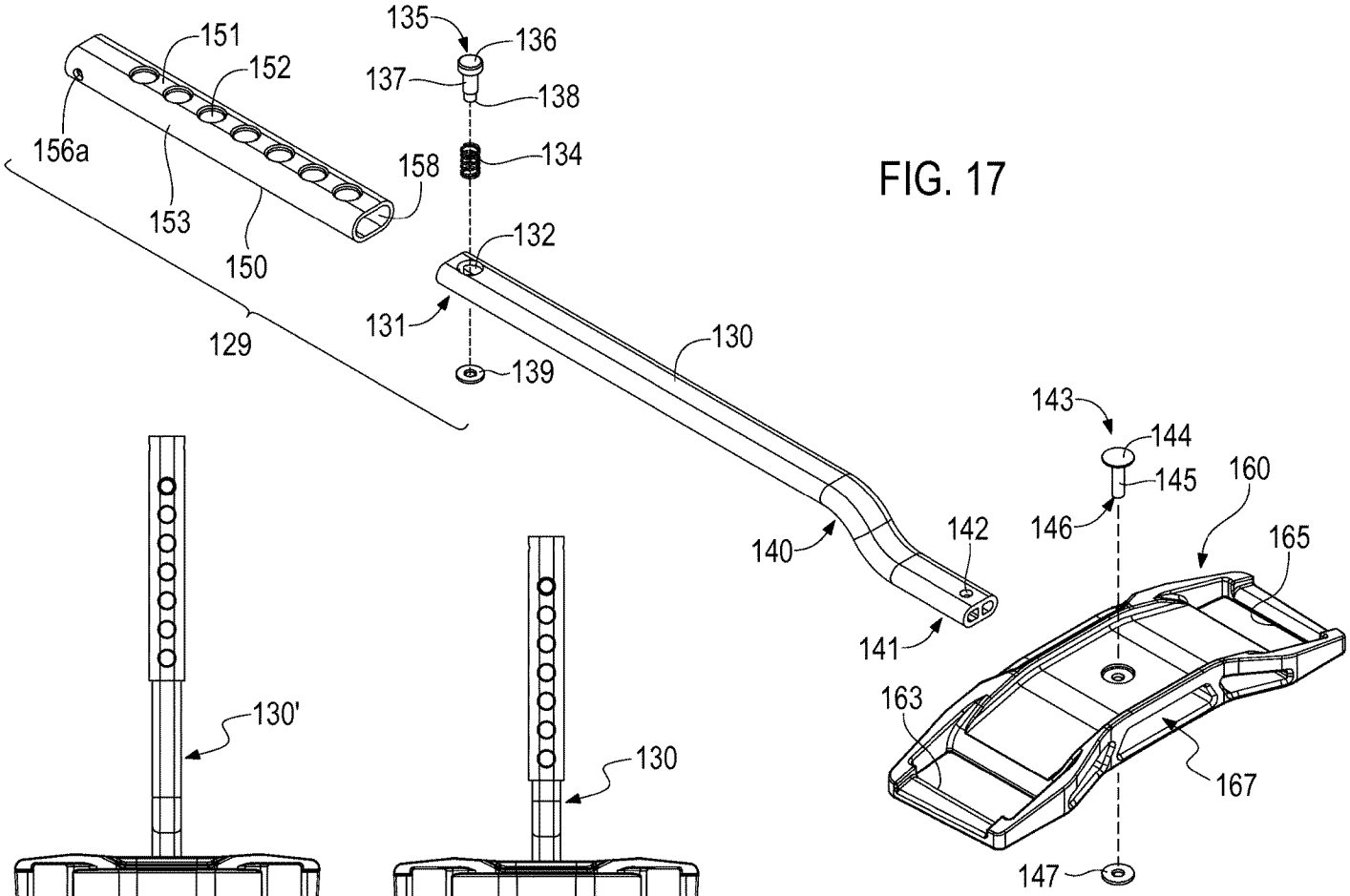
FIG. 17 is an exploded rear perspective view of a support member, an adjustable member, and a connector of the weight distribution assembly shown in FIG. 10.
Figure 19:
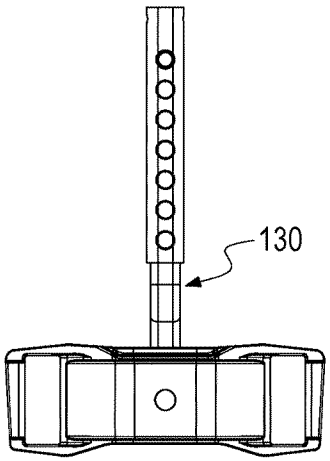
FIG. 19 is a rear view of the portions of the weight distribution assembly shown in FIG. 17 with a second embodiment support member.
Figure 18:
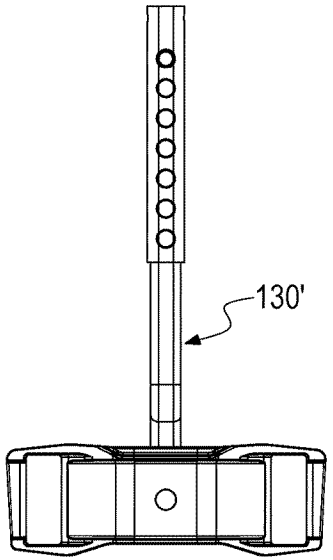
FIG. 18 is a rear view of the portions of the weight distribution assembly shown in FIG. 17 with a first embodiment support member.
Figure 20:
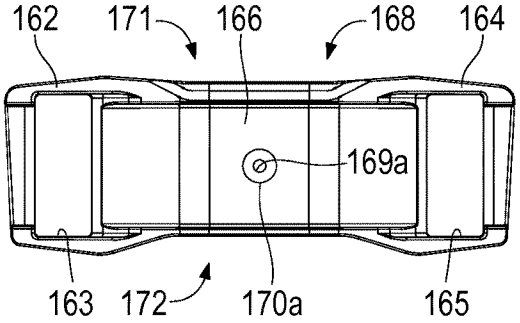
FIG. 20 is a rear view of the connector shown in FIG. 17.
Figure 23:
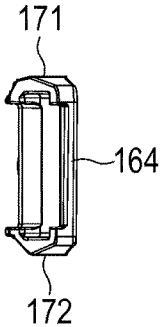
FIG. 23 is a side view of the connector shown in FIG. 20.
Figure 24:
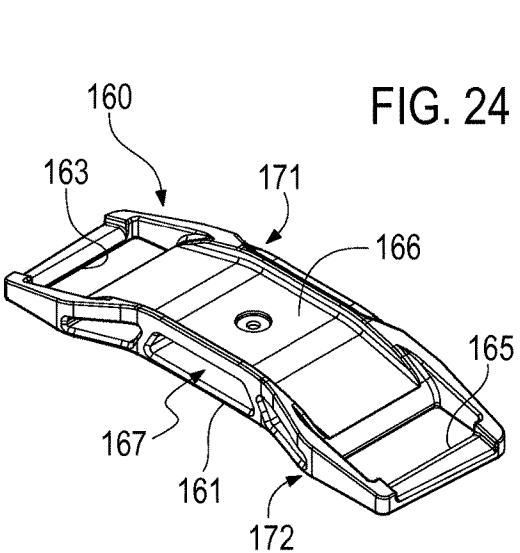
FIG. 24 is a rear perspective view of the connector shown in FIG. 20.
Figure 21:
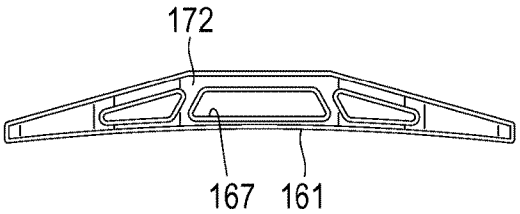
FIG. 21 is a bottom view of the connector shown in FIG. 20.
Figure 25:
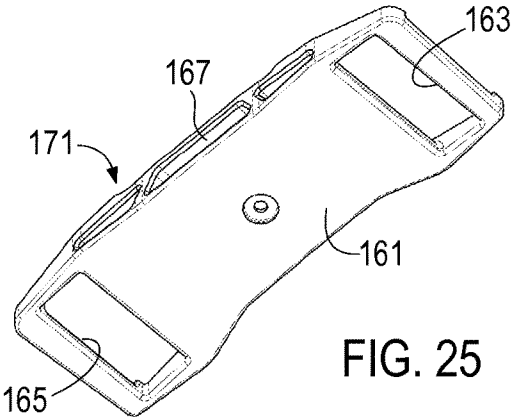
FIG. 25 is a front perspective view of the connector shown in FIG. 20.
Figure 22:
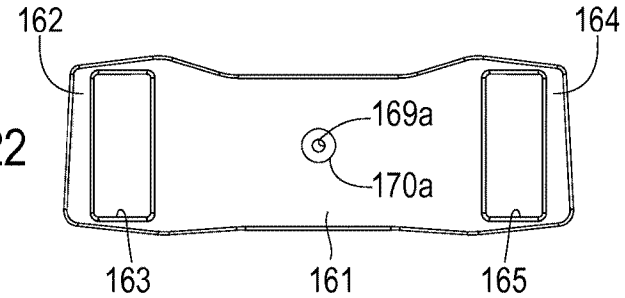
FIG. 22 is a front view of the connector shown in FIG. 20.

As shown in FIGS. 18, 19, and 26-35, different lengths could be used for the support member. For example, the support member 130 could be used for a regular size harness and the longer support member 130' could be used for a tall size harness. FIGS. 31-35 show the corresponding elements for the longer support member 130'. The support member 130' is preferably an elongate member including a bend 140' proximate its second, bottom end 141'. The bend 140' allows the first, top end 131' to be proximate the user's shoulder blades and the second, bottom end 141' to be proximate the user's waist, which allows for a more downward, vertical transfer of weight. Preferably, like the bend 140, the bend 140' creates an offset to help keep the support member 130' away from the user's back when bending forward. At least one bore may extend longitudinally through the support member 130' to reduce its weight. The first end 131' includes an aperture 132' extending through its top and bottom surfaces. As shown in FIGS. 26 and 27, the aperture 132' is larger proximate the top surface than the bottom surface to form a seat portion 133'. The aperture 132' is configured and arranged to receive a button assembly similar to that shown in FIG. 17.

Figure 10:
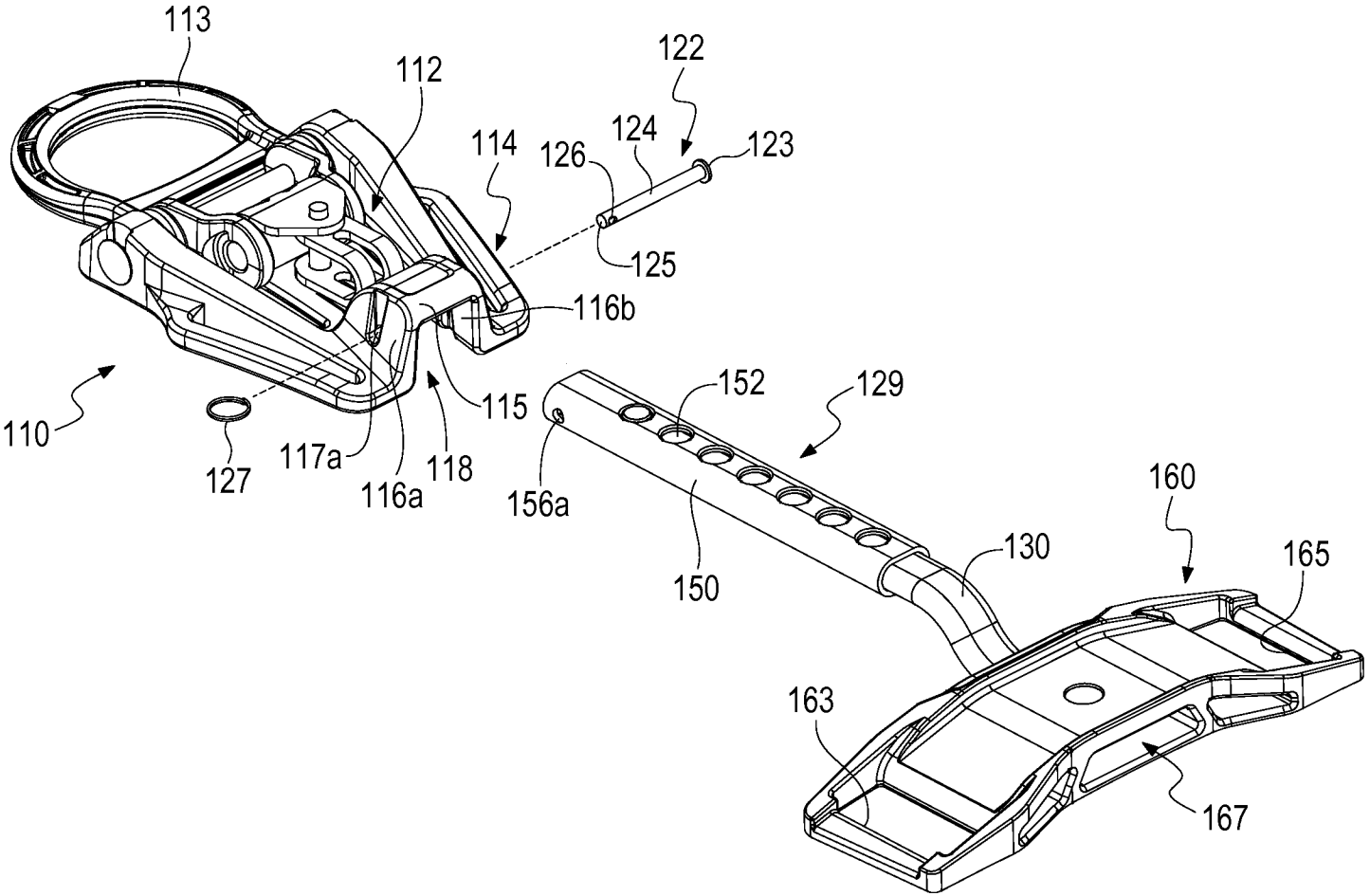
FIG. 10 is a rear perspective view of the weight distribution assembly of the safety harness shown in FIG. 1.
Figure 13:
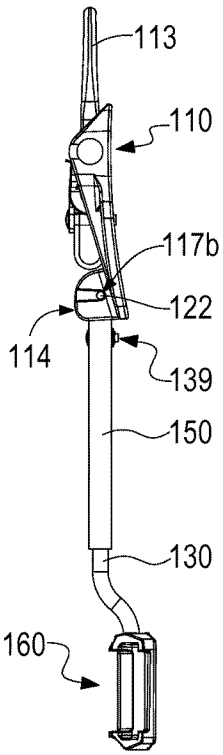
FIG. 13 is a side view of the weight distribution assembly shown in FIG. 10.
Figure 11:
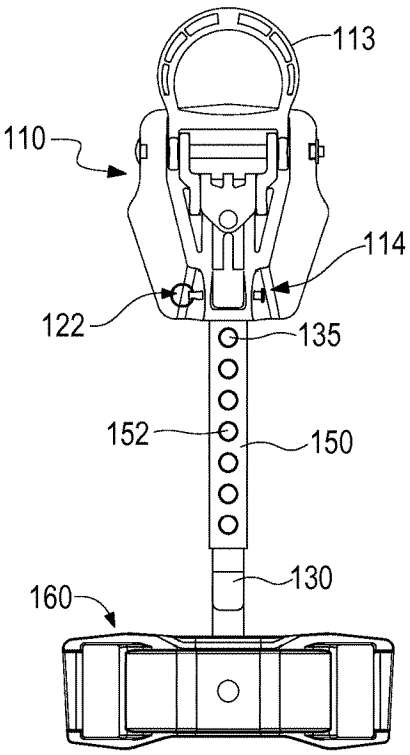
FIG. 11 is a rear view of the weight distribution assembly shown in FIG. 10.
Figure 12:
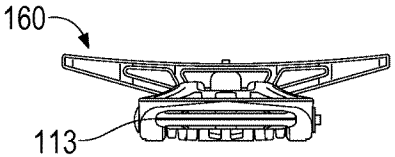
FIG. 12 is a top view of the weight distribution assembly shown in FIG. 10.
Figure 16:
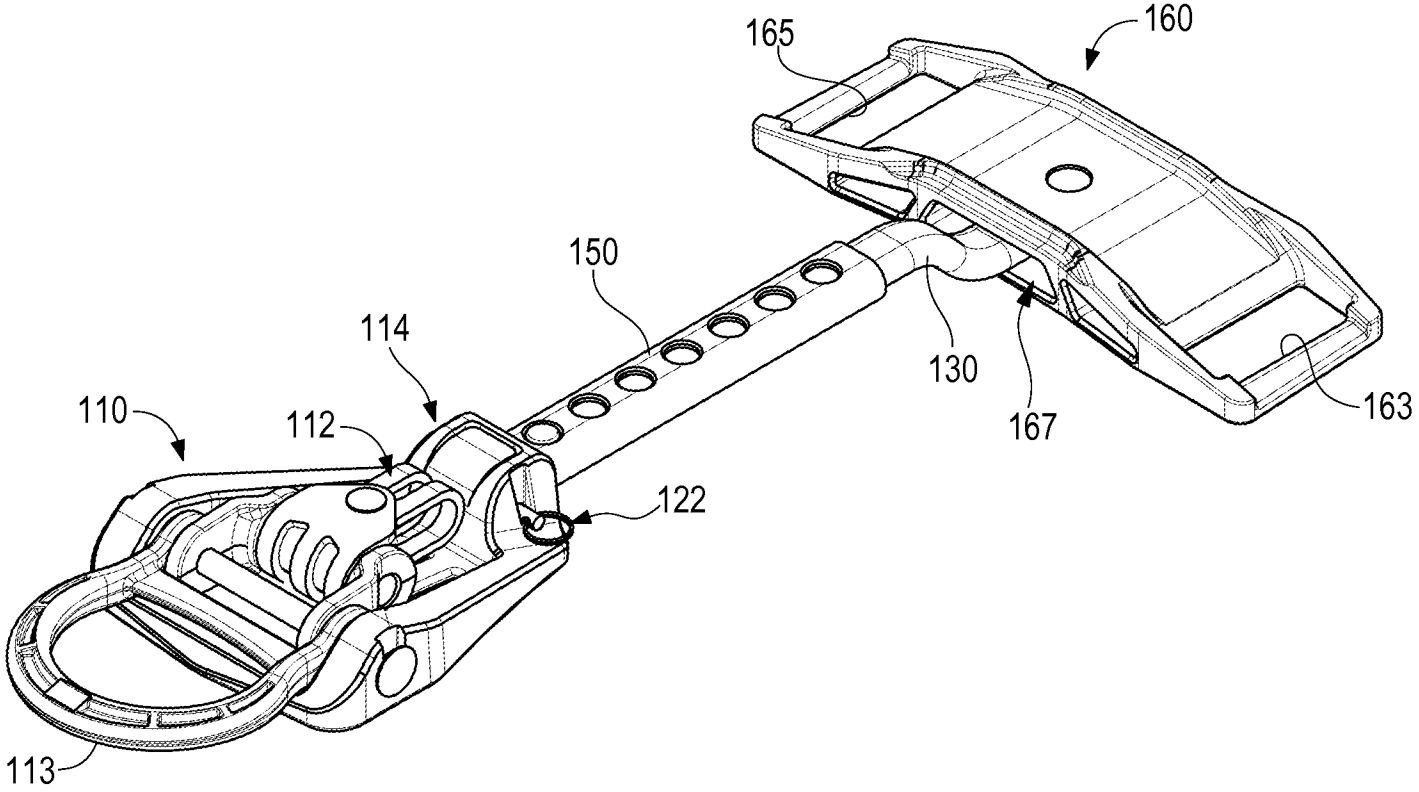
FIG. 16 is a rear perspective view of the weight distribution assembly shown in FIG. 10.

The adjustable member 150 is shown in FIGS. 36-41. The adjustable member 150 is generally cylindrical with a bore 158 configured and arranged to receive the support member 130 or 130'. The adjustable member 150 includes a top 151 along which a plurality of apertures 152 are spaced, sides 153 interconnecting the top 151 and a rear 154, which includes a slot 154*a* extending from proximate a first end 155 to a second end 157. The first end 155 includes apertures 156*a* and 156*b* in its sides. The adjustable member 150 is configured and arranged to slide relative to the support member 130 or 130'. The button 135 of the support member 130 or 130' is configured and arranged to extend through one of the apertures 152 to adjust the length of the support assembly as desired, and the slot 154*a* allows the end 138 of the button 135 to slide along the length when the button 135 is pressed. Preferably, the securing member 139 of the button 135 is positioned external to the adjustable member 150, as shown in FIGS. 13 and 15. The button 135 has a first, engaging position in which it is biased outward from the support member 130 or 130' by the biasing member 134 and a second, releasing position in which it compresses the biasing member 134. In the engaging position, the button 135 extends through one of the apertures 152 and, in the releasing position, the button 135 does not extend through one of the apertures 152 and allows the support member 130 or 130' and the adjustable member 150 to slide relative to one another. As shown in FIG. 10, the fastener 122 extends through the apertures 117*a* and 117*b* in the receiver portion 114 and through the apertures 156*a* and 156*b* in the adjustable member 150 to pivotally connect them.

It is recognized that other suitable types of adjustment devices could be used. For example, a plurality of corresponding apertures could extend along the sides of the adjustable member and the support member and a fastener such as a quick release pin could be used to connect them at the desired length. Other ways to make the support assembly adjustable could include but are not limited to: an assembly including two telescoping tubular members that utilize a nut and tapered threads on the external member to apply radial pressure on the internal member; two members where one member includes notches, holes, or other suitable receiving geometry and the other member includes a feature that is able to rotate about an axis perpendicular to the support assembly into a position that will engage the receiving geometry; a telescoping assembly that utilizes a rotatable cam to apply pressure on the internal member; an assembly that incorporates a male threaded portion and a female threaded nut to shorten or elongate the support member by rotation of either component; and a telescoping assembly that includes a set screw or other threaded component to apply pressure to the internal member.

The connector 160 interconnects the support member 130 or 130' and the waist strap 106. The connector 160 includes a rear plate portion 161 having a first end 162 with an opening 163 and a second end 164 with an opening 165. A front plate portion 166 extends between the openings 163 and 165 and forms at least one channel or cavity 167 proximate a middle portion 168 between the front and rear plate portions 166 and 161. The front plate portion 166 includes an aperture 169*a* and a receptacle 170*a*, which is a countersunk portion about the aperture 169*a*, and the rear plate portion 161 includes an aperture 169*b* and a receptacle 170*b*, which is a countersunk portion about the aperture 169*b*. Sides 171 and 172 extend outward from the front and rear plate portions 166 and 161. The waist strap 106 extends through the opening 163, over the front plate portion 166, and through the opening 165. The sides 171 and 172 keep the waist strap 106 in position on the connector. The connector 160 could also be incorporated into the hip pad of the harness by either being operatively connected to the hip pad or integral with the hip pad.

As shown in FIG. 10, a fastener 143 connects the support member 130 or 130' to the connector 160. The fastener 143 includes a head 144, a shaft 145, and an end 146 with a cavity 146*a* extending longitudinally through a portion of its distal end. The fastener 143 extends through the aperture 142 in the support member and through the apertures 169*a* and 169*b* in the connector 160. The head 144 of the fastener 143 is seated in the receptacle 170*a*, and a securing member 147 is seated in the receptacle 170*b*. These are shown in FIGS. 49-53. The end 146 of the fastener 143 is deformed like a rivet to secure the fastener 143, and the securing member 147 is a washer. The channel or cavity 167 allows the support member 130 or 130' to pivot relative to the fastener 143.

In operation, the user determines whether the support assembly is the desired length. To adjust its length, the user presses the button 135 to move it into the releasing position and then slides the support member 130 or 130' and the adjustable member 150 to the desired length. Because the button 135 is biased by the biasing member 134, the button 135 will extend through the adjacent aperture 152 and the user will need to press the button 135 each time to continue adjusting the length. This may be done before or after the user dons the harness. After the user is donning the harness, the support assembly is pivotable about the fastener 122 in a first direction and about the fastener 143 in a second direction for added mobility and comfort. For example, the support assembly is allowed to rotate so that the user does not feel resistance by the support assembly when bending from side to side.

Figure 54:
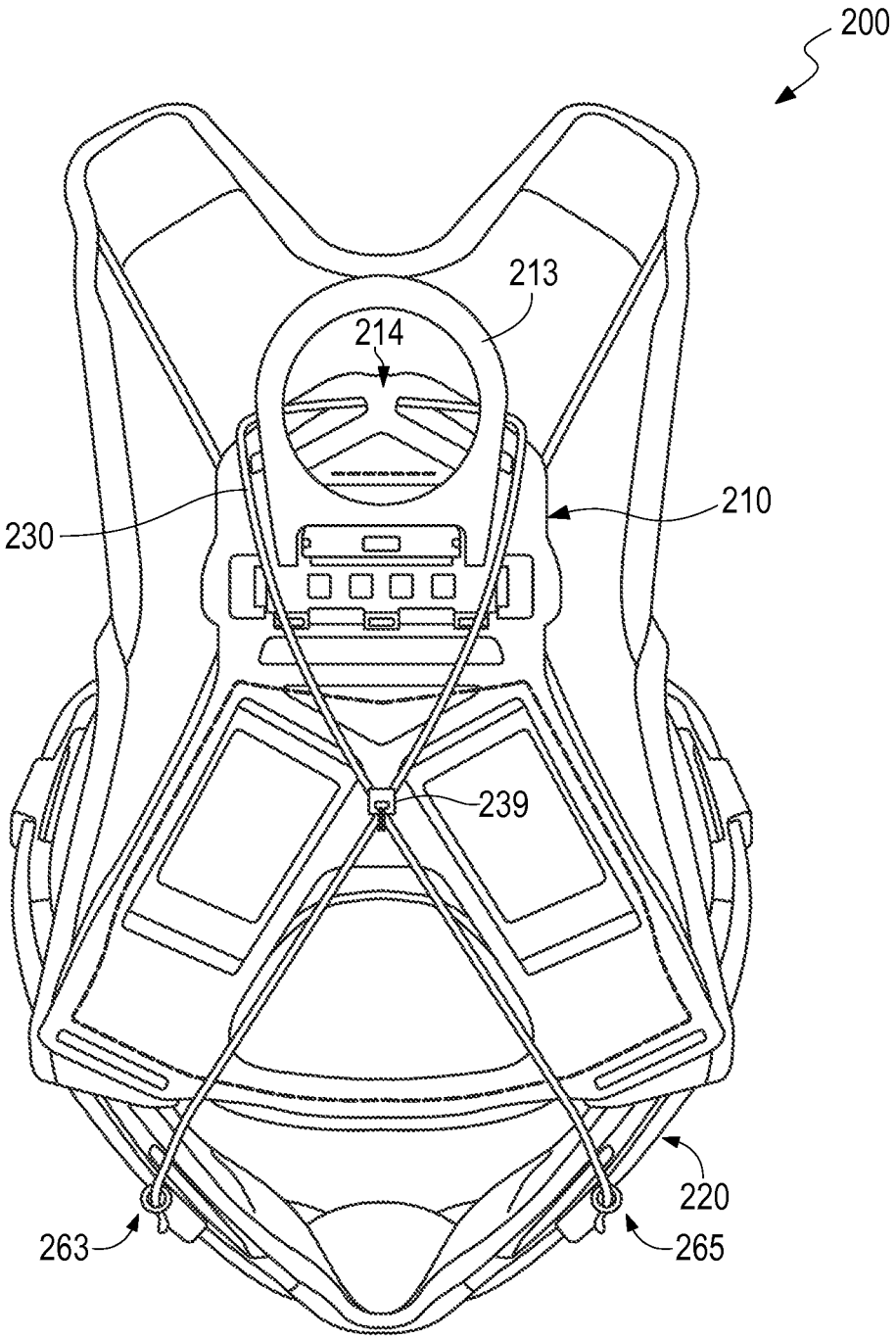
FIG. 54 is a rear view of another embodiment safety harness including another embodiment weight distribution assembly constructed in accordance with the present invention.

As shown in FIG. 54, a harness 200 includes another embodiment weight distribution assembly. In this embodiment, the support member 230 is an elongate member operatively connected to the dorsal pad assembly 210 proximate above and below the D-ring 213. An intermediate portion of the support member 230 extends through a receiving channel 214 in the dorsal pad assembly 210 above the D-ring 213, is bent on each side of the D-ring 213, and then the two legs crisscross below the D-ring 213 to form a generally triangular shape. The juncture of the two legs where they crisscross and extend in a divergent manner is secured to the dorsal pad assembly 210 with a securing member 239. The legs extend downward and operatively connect to the waist belt/hip pad 220, which includes fastening members 263 and 265 to secure the legs to the waist belt/hip pad 220. By interconnecting the dorsal pad assembly 210 and the waist belt/hip pad 220 with the support member 230, weight is transferred from proximate the dorsal pad assembly 210 to proximate the waist belt/hip pad 220.

Figure 55:
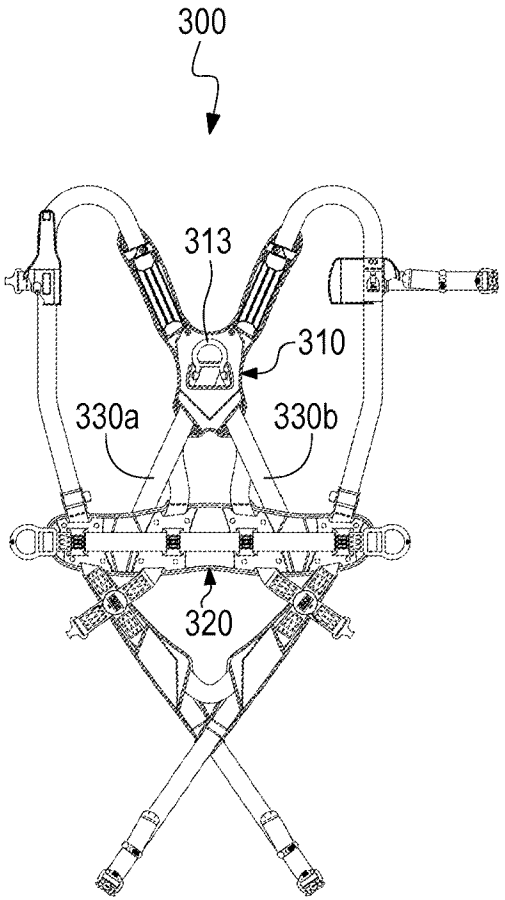
FIG. 55 is a rear view of another embodiment safety harness including another embodiment weight distribution assembly constructed in accordance with the present invention.

As shown in FIG. 55, a harness 300 includes another embodiment weight distribution assembly. In this embodiment, the support member includes a first support member 330*a* and a second support member 330*b* interconnecting the dorsal pad assembly 310 and the waist belt/hip pad 320 proximate the route of the shoulder straps between the dorsal pad assembly 310 and the waist belt/hip pad 320. The support members 330*a* and 330*b* could be sewn or otherwise connected using a variety of common fasteners to the dorsal pad assembly 310 and the waist belt/hip pad 320. Another option is to include pockets on or inside the hip pad into which the support members 330*a* and 330*b* are inserted. The dorsal pad assembly 310 could be made of injection molded plastic (e.g., nylon 6-6) and acts as a housing to support a spring biased D-ring 313 (e.g., such as that disclosed in U.S. Pat. No. 7,073,627) and helps direct the harness shoulder strap webbing through the D-ring 313 opening. Another option is that the dorsal pad assembly 310 and the support members 330*a* and 330*b* could be one assembly/component instead of two separate components connected together. This could also work the other way in which the support members 330*a* and 330*b* are part of the hip pad and is connected to the dorsal pad assembly 310. Yet another option is that the dorsal pad assembly 310, the hip pad, and the support member(s) could all be one assembly/component that is incorporated into the harness.

Figure 56:
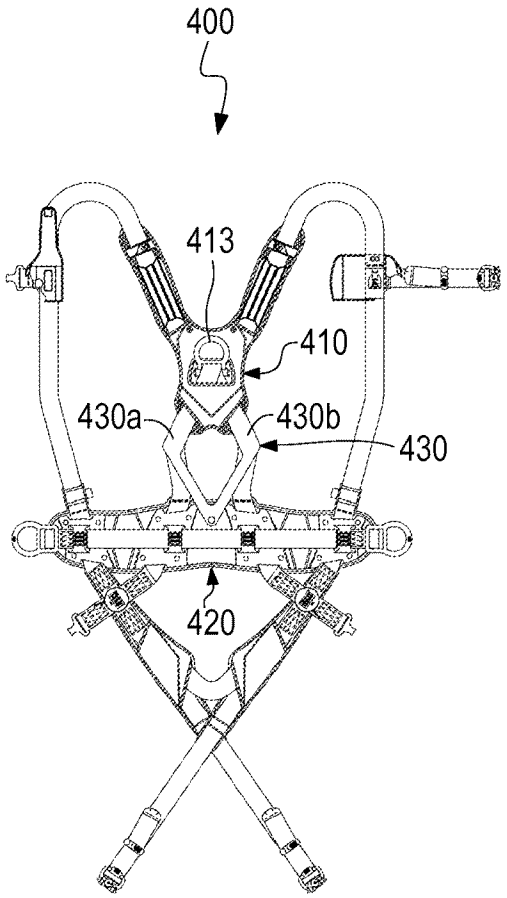
FIG. 56 is a rear view of another embodiment safety harness including another embodiment weight distribution assembly constructed in accordance with the present invention.

As shown in FIG. 56, a harness 400 includes another embodiment weight distribution assembly. In this embodiment, the support member 430 is generally diamond shaped and two sides 430*a* and 430*b* form an opening between the dorsal pad assembly 410 and the waist belt/hip pad 420 for ventilation and an optional pivot proximate the waist belt/hip pad 420 for better mobility. The support member 430 extends under the fabric cover proximate the dorsal pad assembly 410 and is mechanically fastened to the dorsal pad assembly 410 proximate the D-ring 413 with a rivet, bolt, etc. This could also be accomplished via stitching or other suitable fastening member.

Figure 57:
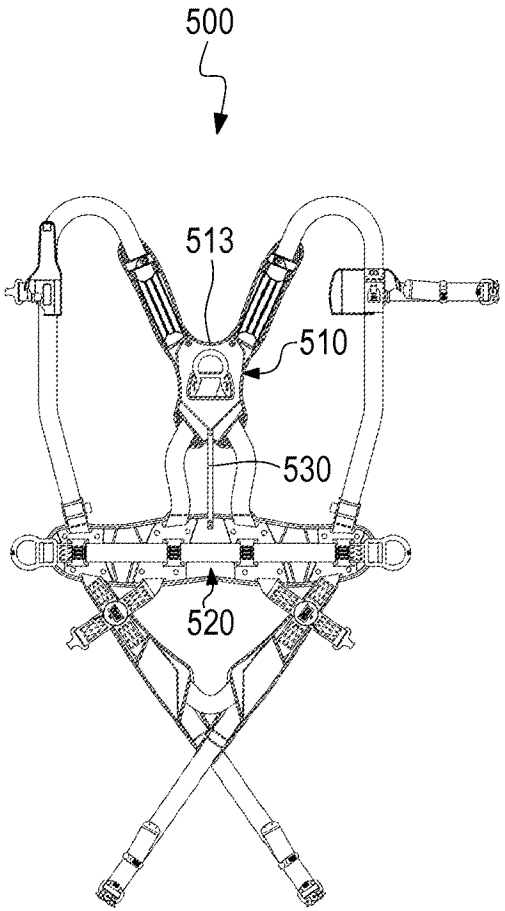
FIG. 57 is a rear view of another embodiment safety harness including another embodiment weight distribution assembly constructed in accordance with the present invention.

As shown in FIG. 57, a harness 500 includes another embodiment weight distribution assembly. In this embodiment, the support member 530 is a rod-like member with an optional pivot proximate one or both of the dorsal pad assembly 510 and the waist belt/hip pad 520. The top of the support member 530 is operatively connected to the dorsal pad assembly 510 proximate the D-ring 513. The support member 530 could be a single member or it could include a first support member with a channel in which a second support member could slidably move thereby providing an adjustable support member, and a suitable locking mechanism could interconnect the first and second support members at the desired length. For example, the second support member could include a protrusion or a fastening member configured and arranged to extend through any of a plurality of notches or apertures formed in the first support member.

Figure 60:
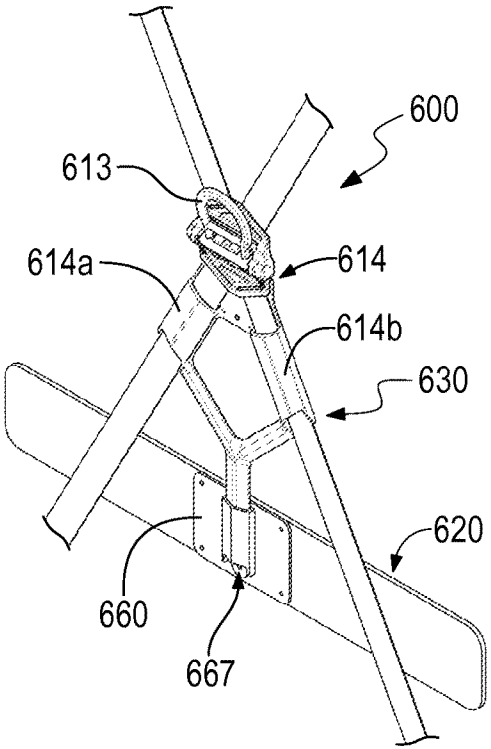
FIG. 60 is a rear perspective view of the safety harness shown in FIG. 58.
Figure 59:
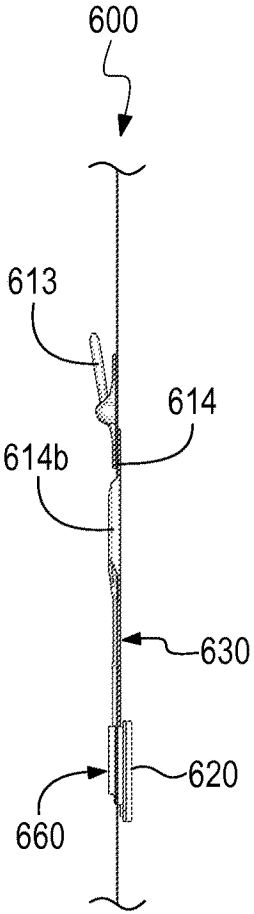
FIG. 59 is a side view of the safety harness shown in FIG. 58.
Figure 58:
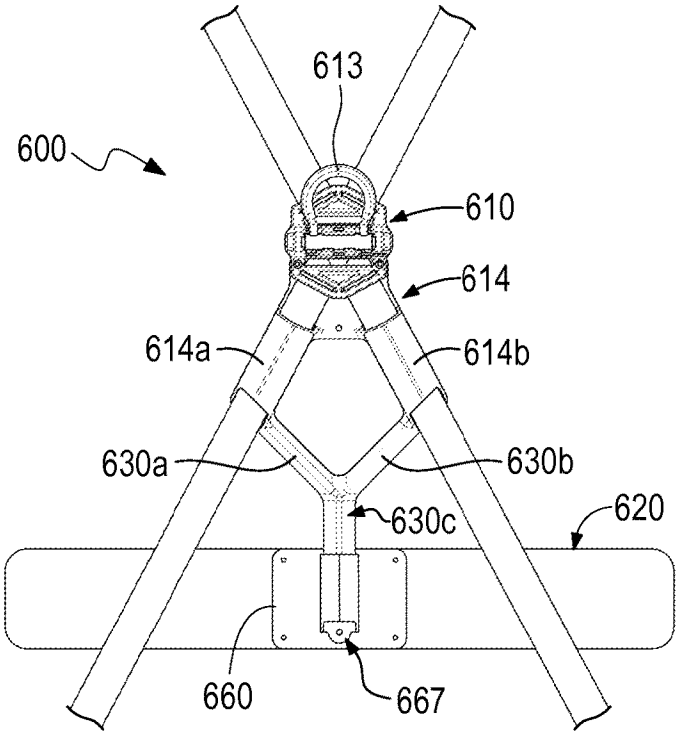
FIG. 58 is a rear view of another embodiment safety harness including another embodiment weight distribution assembly constructed in accordance with the present invention.

As shown in FIGS. 58-60, a harness 600 includes another embodiment weight distribution assembly. In this embodiment, the support member 630 could be integral with the dorsal pad assembly 610 and is operatively connected to the waist belt/hip pad 620. An extension portion 614 extends downward from the dorsal pad assembly 610 proximate the D-ring 613. Although it is preferred that the extension portion 614 is integral with the dorsal pad assembly 610, they may be separate components operatively connected together by suitable means well known in the art. Extending downward from the extension portion 614 are channel-forming portions 614*a* and 614*b* through which the shoulder straps are routed. The support member 630 includes a Y-shaped portion having legs 630*a* and 630*b* interconnecting the channel-forming portions and leg 630*c*, which is operatively connected to the waist belt/hip pad 620 with a connector 660 having a channel 667 through which the leg 630*c* extends. The support member 630 could also be pivotable proximate the waist belt/hip pad 620. A plate member made of any suitable material could be used to reinforce the waist belt/hip pad. The support member and dorsal pad assembly combination could be injection molded made from durable plastic (e.g., nylon 6-6) but could also be manufactured from aluminum, steel, etc. depending on the level of stiffness desired.

The above specification, examples, and data provide a complete description of the manufacture and use of the composition of embodiments of the invention. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the invention. Therefore, it is manifestly intended that this invention be limited only by the claims and the equivalents thereof.

The invention claimed is:

1. A safety harness configured to arrest a user during a fall event, said safety harness comprising:

shoulder straps;

a dorsal D-ring connected to the shoulder straps;

a waist strap; and a weight distribution assembly interconnecting the shoulder straps proximate the dorsal D-ring and the waist strap, the weight distribution assembly being positioned proximate a user's spine when in use, the weight distribution assembly configured to be loaded in compression and transfer a significant weight from a load suspended from the dorsal D-ring from proximate the shoulder straps to proximate the waist strap.

2. The safety harness of claim 1, wherein the weight distribution assembly includes a dorsal pad assembly interconnecting the shoulder straps proximate the dorsal D-ring.

3. The safety harness of claim 2, wherein the weight distribution assembly includes a support assembly and the dorsal pad assembly includes the D-ring, the support assembly being operatively connected to the dorsal pad assembly in at least one of an upper position above the D-ring and a lower position below the D-ring.

4. The safety harness of claim 1, wherein the weight distribution assembly includes a hip pad through which the waist strap is routed.

5. The safety harness of claim 4, wherein the weight distribution assembly includes a support assembly being operatively connected to the hip pad in a center position on the hip pad.

6. The safety harness of claim 4, wherein the weight distribution assembly includes a support assembly having a first support member and a second support member, the first support member being operatively connected to the hip pad in a first offset position and the second support member being operatively connected to the hip pad in a second offset position, the first and second offset positions being relative to a center position on the hip pad.

7. The safety harness of claim 4, wherein the weight distribution assembly includes a dorsal pad assembly and a support assembly pivotally connected to at least one of the hip pad and the dorsal pad assembly.

8. The safety harness of claim 7, wherein the support assembly is configured and arranged to pivot in a first direction relative to the dorsal pad assembly and to pivot in a second direction relative to the hip pad.

9. The safety harness of claim 1, wherein the weight distribution assembly includes a support assembly comprising a support member and an adjustable member configured and arranged to move along the support member to adjust a length of the support assembly.

10. The safety harness of claim 9, wherein the support member includes a spring biased button and the adjustable member includes a plurality of apertures, the button being configured and arranged to extend through a desired one of the plurality of apertures to adjust the length of the support assembly.

11. A safety harness configured to arrest a user during a fall event, said safety harness comprising:

a dorsal D-ring connected to a dorsal pad assembly;

at least one of a waist belt and a hip pad;

shoulder straps interconnecting the dorsal pad assembly and the at least one of the waist belt and the hip pad; and a support assembly interconnecting the dorsal pad assembly and the at least one of the waist belt and the hip pad, the support assembly being positioned proximate a user's spine when in use, the support assembly configured to be loaded in compression and transfer a majority of an applied weight from a load suspended from the dorsal D-ring from proximate the shoulder straps to proximate the at least one of the waist belt and the hip pad.

12. The safety harness of claim 11, wherein the support assembly is made from a material selected from the group consisting of a metal, a composite, a plastic, and a carbon fiber.

13. The safety harness of claim 11, further comprising at least one pivot assembly interconnecting the support assembly and at least one of the dorsal pad assembly and the at least one of the waist belt and the hip pad.

14. The safety harness of claim 11, wherein the support assembly is integral with the dorsal pad assembly.

15. The safety harness of claim 11, wherein the support assembly is integral with the hip pad.

16. The safety harness of claim 11, wherein the support assembly is a single component support member, the single component support member being operatively connected to the at least one of the waist belt and the hip pad proximate a middle rear portion of the at least one of the waist belt and the hip pad.

17. The safety harness of claim 11, wherein the support assembly includes a first support member portion and a second support member portion, the first and second support member portions being operatively connected to the at least one of the waist belt and the hip pad proximate first and second sides of the at least one of the waist belt and the hip pad.

18. The safety harness of claim 11, wherein the support assembly is adjustable in length.

19. The safety harness of claim 18, wherein the support assembly includes a support member with a spring biased button and an adjustable member with a plurality of apertures, the button being configured and arranged to extend through a desired one of the plurality of apertures to adjust the length of the support assembly.

* * * * *